United States Patent [19]

Koehler

[11] Patent Number: 4,836,277

[45] Date of Patent: Jun. 6, 1989

[54] HEAT EXCHANGER APPARATUS HAVING HEAT EXCHANGER PIPES AND SHEETMETAL PLATES

[75] Inventor: Juergen Koehler, Schwalmstadt, Fed. Rep. of Germany

[73] Assignee: Konvekta, GmbH, Schwalmstadt, Fed. Rep. of Germany

[21] Appl. No.: 178,773

[22] Filed: Mar. 30, 1988

Related U.S. Application Data

[63] Continuation of Ser. No. 893,394, Aug. 5, 1986, abandoned.

[30] Foreign Application Priority Data

Aug. 7, 1985 [DE] Fed. Rep. of Germany ..... 3528499

[51] Int. Cl.[4] ..... E21B 23/00

[52] U.S. Cl. ..... 165/151; 165/148; 29/157.3 B

[58] Field of Search ..... 165/151, 148; 29/157.3, 29/157.3 B

[56] References Cited

U.S. PATENT DOCUMENTS

| | | | |
|---|---|---|---|
| 4,173,998 | 11/1979 | Johoda | 165/151 X |
| 4,465,128 | 8/1984 | Krekács et al. | 165/151 |
| 4,546,822 | 10/1985 | Tamura | 165/151 |
| 4,559,994 | 12/1985 | Waldmann et al. | 165/151 X |

*Primary Examiner*—Larry Jones
*Attorney, Agent, or Firm*—Arthur F. Zobal

[57] ABSTRACT

Described is a heat exchanger apparatus having heat exchanger pipes (20) and sheet-like plates (10) having bores (12). The edge configuration of each plate (10) comprises the side edges (16) of an elongate strip and parallel base edges (18) which cut through the strip inclinedly beside the bores (12). The heat exchanger pipes (20) extend through the bores (12), the diameter (da) of the bores comprising the outside diameter of the heat exchanger pipes and the bores (12) being arranged in a rectangular grid configuration; the longitudinal grid lines (22) extend parallel to the side edges (16) and the transverse grid lines (24) extend normal to the side edge (16). The grid lines (22, 24) are at constant pitches ($s_2$, $s_1$) in the two mutually perpendicular grid directions, with adjacent transverse grid lines (24) being displaced relative to each other by half the grid line pitch ($s_1/2$). The base edge (18) includes with the side edge (16) an angle (A) which is given by the following formula:

$$A = \text{arc } tg \frac{2\,s_2}{3\,s_1}.$$

The base edge (18) is disposed between the bores (12) in a strip region (26) whose width (c) is given by the formula:

$$c = \frac{s_1}{\sqrt{1 + \left(\frac{3\,s_1}{2\,s_2}\right)^2}} - da$$

wherein the diameter (da) and the pitches ($s_1$, $s_2$) are related in such a relationship that the following applies:

$$da < \frac{s_1}{\sqrt{1 + \left(\frac{3\,s_1}{2\,s_2}\right)^2}}$$

12 Claims, 2 Drawing Sheets

HEAT EXCHANGER APPARATUS HAVING HEAT EXCHANGER PIPES AND SHEETMETAL PLATES

Figure 1:
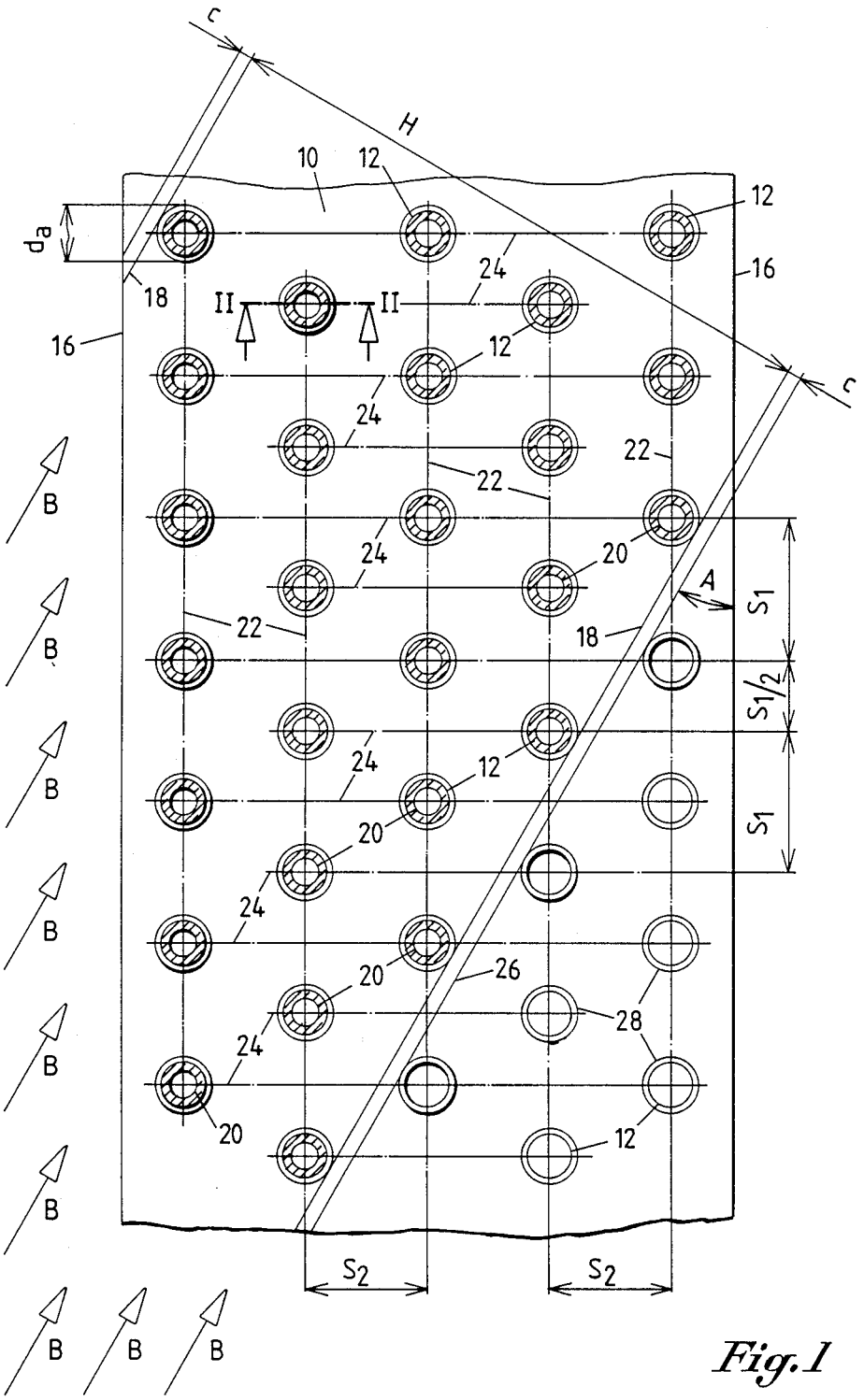

This application is a continuation of copending U.S. patent application Ser. No. 893,394, filed on Aug. 5, 1986 now abandoned.

The invention relates to a heat exchanger apparatus comprising heat exchanger pipes and sheet metal plates which have bores and whose edge configuration comprises the side edges of an elongate strip and parallel base edges which cut through the strip inclinedly beside the bores, wherein the heat exchanger pipes extend through the bores whose diameter (da) comprises the outside diameter of the heat exchanger pipes and which are arranged in a rectangular grid whose longitudinal grid lines extend in parallel relationship to the side edges of the edge configuration of the plates and whose transverse grid lines extend in normal relationship to said side edges, wherein the grid lines are at constant pitches in the two mutually perpendicular grid directions, and wherein adjacent grid lines are displaced relative to each other by half the grid line pitch ($s_1/2$).

Heat exchanger apparatuses of that kind, having sheet metal plates whose edge configuration comprises the side edges of a strip and base edges which extend parallel to each other and which cut through the rectangle inclinedly beside the bores, are known. In the known heat exchanger apparatus, the angle which each base edge includes with the longitudinal edge of the strip is given by the arc tg of the quotient of the pitch of the transverse grid lines, relative to the pitch of the longitudinal grid lines. The base edges which cut through the elongate strip inclinedly beside the bores serve in that arrangement to reduce the overall height of the heat exchanger, such height being measured perpendicularly to the base edges which cut through the strip inclinedly beside the bores. In such a heat exchanger apparatus, the displaced configuration of the heat exchanger pipes, due to the arrangement of the base edges which cut through the elongate strip inclinedly beside the bores, becomes an aligned arrangement, thereby giving a reduction in the level of thermal efficiency of the heat exchanger apparatus.

The object of the present invention is therefore that of providing a heat exchanger apparatus of the kind set forth in the opening part of this specification, in which a suitable selection in respect of the cut through the elongate strip can provide that the overall height of the heat exchanger apparatus is further reduced and at the same time adjacent heat exchanger pipes are not aligned with each other, in an advantageous manner.

In accordance with the present invention, that object is attained in that the base edge includes with the side edge of the edge configuration an angle A which is given by the following formula:

$$A = \text{arc } tg \frac{2\,s_2}{3\,s_1}.$$

and that the base edge lies between the bores in a strip region whose width c is given by the following formula:

$$c = \frac{s_1}{\sqrt{1 + \left(\frac{3\,s_1}{2\,s_2}\right)^2}} - d_a$$

wherein the diameter da and the pitches are related in such a relationship that the following applies:

$$da < \frac{s_1}{\sqrt{1 + \left(\frac{3\,s_1}{2\,s_2}\right)^2}}$$

By virtue of the recurring cut through the strip along the base edges, in accordance with the last-mentioned formulae, that arrangement gives the advantage that the heat exchanger pipes are not aligned with each other but are displaced relative to each other, as considered in the direction of flow to the heat exchanger apparatus. That gives a comparatively high level of thermal efficiency in the heat exchanger apparatus. A considerable advantage of the heat exchanger apparatus in accordance with the present invention is that the overall installation height thereof, over the base edge which extends at an inclined angle with respect to the edge configuration, is smaller with a corresponding level of thermal efficiency, than in a known heat exchanger apparatus of the genral kind set forth.

The bores in each plate may have a collar therearound, wherein the collars extend perpendicularly away from the plate and point in the same direction. With such a construction, the diameter (da) of the bores include double to wall thickness or gauge of the collar portion disposed around the bore, that is to say, it comprises the inside diameter of the bore which corresponds to the outside diameter of the heat exchanger pipe, and double the wall thickness or gauge of the collar portion.

Figure 2:
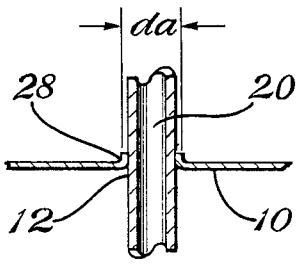
Figure 3:
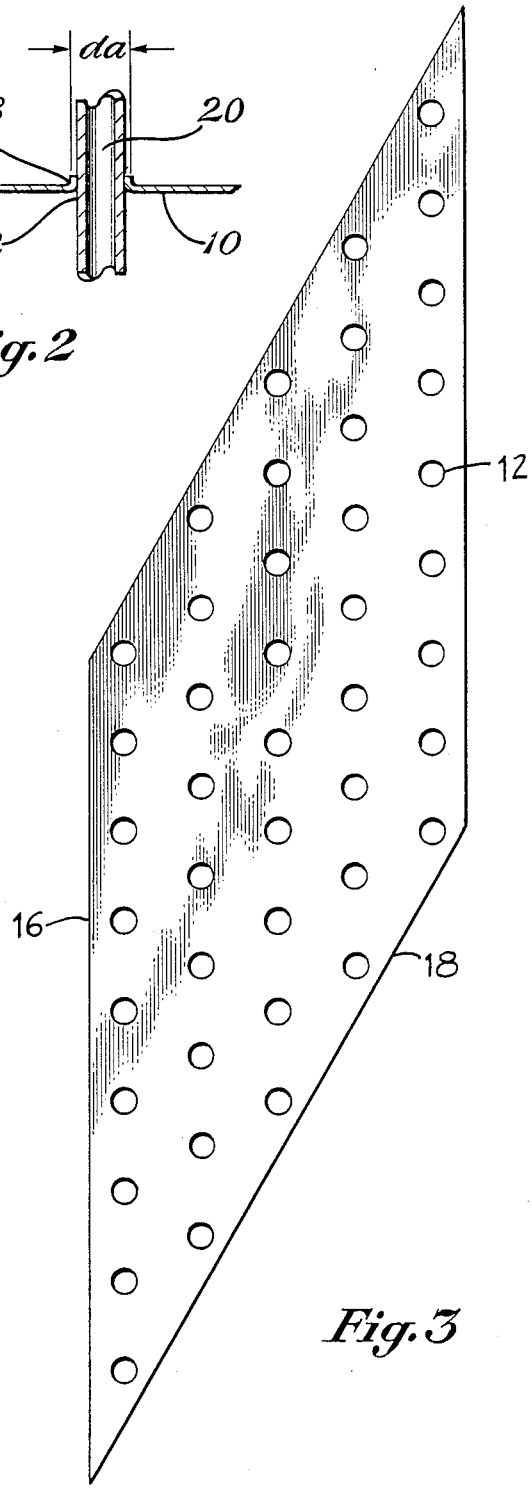

Further details, features and advantages will be apparent from the following description of a heat exchanger apparatus according to the invention, as shown in the drawings in which:

FIG. 1 is a view in cross-section through a portion of a heat exchanger apparatus illustrating the manner in which its sheet metal plates are formed from a strip of sheet metal, FIG. 2 is a view in section taken along line II—II in FIG. 1, showing only portions of a plate and a heat exchanger pipe which is mounted in the plate, and FIG. 3 is a plan view of a sheet metal plate of a heat exchanger apparatus formed from the strip of sheet metal of FIG. 1. In FIG. 3 the collars of the bores are not shown.

Referring to FIG. 1 shown therein is a portion of an elongate band or strip from which sheet metal plates 10 are cut out. The plates 10 have bores 12. The edge configuration of each sheet-like plate 10 comprises the elongate side edges 16 which extend in parallel relationship to each other, and base edges 18 which cut through the strip inclinedly beside the bores 12.

As can be seen from FIG. 2, the heat exchanger pipes 20 extend through the bores 12 in the plates 10, only a portion of a heat exchanger pipe 20 being illustrated in FIG. 2. The inside diameter of the bores 12 in the plates 10 corresponds to the outside diameter of the heat exchanger pipes. The bores 12 are arranged in the plate 10 in a rectangular grid which is indicated in FIG. 1 by the dash-dotted lines 22 and 24. The longitudinal grid lines 22 and the transverse grid lines 24 have constant pitches or spacings $s_2$ and $s_1$ respectively, wherein adjacent transverse lines 24 are displaced relative to each other by half the grid pitch $s_1/2$.

In the heat exchanger apparatus in accordance with the invention, the base edge 18 which cuts inclinedly through the strip includes with the elongate side edge 16 an angle A which is given by the following formula:

$$A = \text{arc } tg \frac{2\,s_2}{3\,s_1}$$

The cut line lies within a strip-like region 26 which is illustrated in FIG. 1 by the crossed hatching and which is for example of a width C=2 mm. That width is predetermined by the width of the cutting tool which is to be used to cut through the strip. With a narrower tool, the parameter c may also be 1 mm and below. The width c is determined by the dimensions of the bores and the arrangement thereof in a rectangular grid; it is given by the formula:

$$c = \frac{s_1}{\sqrt{1 + \left(\frac{3\,s_1}{2\,s_2}\right)^2}} - d_a$$

As can be clearly seen from FIG. 2, the bores 12 in the plate 10 each have a collar 28 therearound, which is produced from the material of the sheet-like plate 10 by a flanging operation. Each collar 28 projects perpendicularly away from the plate 10, all collars pointing in the same direction away from the plate 10. If the plates 10 have bores 12 with collars 28, then the diameter da of the bores 12 comprises the inside diameter of the bore 12 and double the wall thickness or gauge of the collar 28 disposed around the bore 12 (see FIG. 2).

In FIG. 1 reference 'H' denotes the installation height of the heat exchanger apparatus in accordance with the invention; in an advantageous manner, with virtually the same number of heat exchanger pipes 12 as in a known heat exchanger apparatus, the installation height H of the heat exchanger apparatus according to the invention is smaller than the installation height of a known heat exchanger apparatus of the general kind set forth. The arrows 'B' which extend in parallel juxtaposed relationship indicate the direction of flow to the heat exchanger apparatus of a fluid which undergoes exchange in respect of its energy with the fluid flowing through the heat exchanger pipes 20.

As can be clearly seen from FIG. 1, the flow direction B is in parallel relationship to the base edges 18 of the plate, which is oriented at least approximately horizontally in the normal position of use of the heat exchanger.

I claim:

1. A heat exchanger apparatus of increased efficiency and reduced height, comprising heat exchanger pipes (20) and sheet-like plates (10) each of which has bores (12) and whose edge configuration comprises the side edges (16) of an elongate strip and parallel base edges (18) which cut through the strip inclinedly beside the bores (12), wherein the heat exchanger pipes (20) extend through the bores (12) whose diameter (da) comprises the outside diameter of the heat exchanger pipes (20) and which are arranged in a rectangular grid whose longitudinal grid lines (22) extend in parallel relationship to the side edges (16) of said edge configuration and whose transverse grid lines (24) extend in normal relationship to said side edges (16), wherein the grid lines (22, 24) are at constant pitches ($s_2$, $s_1$) in the two mutually perpendicularly grid directions, and wherein adjacent grid lines (24) are displaced relative to each other by half the grid line pitch ($s_1/2$), characterized in that the base edge (18) includes with the side edge (16) an angle (A) which is given by the following formula:

$$A = \text{arc } tg \frac{2\,s_2}{3\,s_1}$$

and that the base edge (18) lies between the bores (12) in a strip region (26) whose width (c) is given by the following formula:

$$c = \frac{s_1}{\sqrt{1 + \left(\frac{3\,s_1}{2\,s_2}\right)^2}} - da$$

wherein the diameter (da) and the pitches ($s_1$, $s_2$) are related in such a relationship that the following applies:

$$da < \frac{s_1}{\sqrt{1 + \left(\frac{3\,s_1}{2\,s_2}\right)^2}},$$

wherein an increased number of bores (12) are located along spaced apart lines parallel to said side edges (16) for a given height (H).

2. The heat exchanger apparatus of claim 1, wherein: said sheet like plates are arranged such that the direction of flow of a fluid to said heat exchanger apparatus exterior of said pipes is generally parallel to said base edges.

3. A heat exchanger apparatus of increased efficiency and reduced height, comprising:

a sheet metal plate formed from a metal strip having two spaced apart parallel side edges with bores formed through said strip arranged along longitudinal grid lines which are spaced apart and parallel to each other and to said side edges with the centers of adjacent bores along each of said longitudinal grid lines being spaced apart by a distance $s_1$ and adjacent longitudinal grid lines being spaced apart by a distance $s_2$ and with the longitudinal grid lines next to said two side edges being spaced from said two side edges respectively, said bores being arranged along transverse grid lines normal to said longitudinal grid lines with alternate transverse grid lines being spaced apart by a distance $s_1$ and adjacent transverse grid lines being spaced apart by a distance $s_1/2$, the centers of adjacent bores along each transverse grid line being spaced apart by a distance $2s_2$, all of said bores having substantially the same size and being of dimensions such that parallel spaced apart straight strip regions extend diagonally between said two side edges and between said bores, each strip region forms equal acute angles with said two side edges and extends between a pair of adjacent bores along each of said longitudinal grid lines wherein the pairs of adjacent bores of adjacent longitudinal grid lines between which a given strip region extends are longitudinally spaced from each other with the centers of the closest bores of adjacent pairs of bores of adjacent longitudinal grid lines between which a given strip region extends being longitudinally spaced from each other by a distance of $s_1/2$, said sheet metal plate being cut from said metal strip along two of said spaced apart strip regions forming two base edges with one of said base edges defining the height of said sheet metal plate relative to the other of said base edges, wherein an increased number of bores are located along spaced apart lines parallel to said side edges for a given height of said sheet metal plate, pipes extending through said bores of said sheet metal plate, said heat exchanger apparatus being arranged such that the direction of flow of fluid through said heat exchanger apparatus exterior of said pipes will be generally parallel to said two base edges.

4. The heat exchanger apparatus of claim 3, comprising:

a plurality of said sheet metal plates with said pipes extending through said bores of said plurality of sheet metal plates, said heat exchanger apparatus being arranged such that the direction of flow of fluid through said heat exchanger apparatus exterior of said pipes will be generally parallel to said base edges of said plurality of sheet metal plates.

5. The heat exchanger apparatus of claim 3, wherein: each of said acute angles A is defined as follows:

$$A = \text{arc } tg \frac{2\,s_2}{3\,s_1}$$

the width c of each of said strip regions is defined as follows:

$$c = \frac{s_1}{\sqrt{1 + \left(\frac{3\,s_1}{2\,s_2}\right)^2}} - da$$

wherein:

$$da < \frac{s_1}{\sqrt{1 + \left(\frac{3\,s_1}{2\,s_2}\right)^2}}.$$

6. The heat exchanger apparatus of claim 5 wherein each of said bores has a collar formed therearound, said collars project perpendicularly from said plate, each of said collars has an outside diameter that is the sum of the inside diameter of the respective bore and twice the thickness of the respective collar, wherein said strip regions extend diagonally between said two side edges and said collar outside diameters.

7. The heat exchanger apparatus of claim 3 wherein said bores have inside diameters and said pipes have outside diameters that correspond generally to the inside diameter of said bores.

8. The heat exchanger apparatus of claim 7 wherein each of said bores has a collar formed therearound, said collars project perpendicularly from said plate, each of said collars has an outside diameter that is the sum of the inside diameter of the respective bore and twice the thickness of the respective collar, wherein said strip regions extend diagonally between said two side edges and said collar outside diameters.

9. The heat exchanger apparatus of claim 3 wherein each of said bores has a collar formed therearound, said collars project perpendicularly from said plate, each of said collars has an outside diameter that is the sum of the inside diameter of the respective bore and twice the thickness of the respective collar, wherein said strip regions extend diagonally between said two side edges and said collar outside diameters.

10. A method of forming a heat exchanger apparatus from a metal strip having two spaced apart parallel side edges with bores formed through said strip and arranged along longitudinal grid lines which are spaced apart and parallel to each other and to said edges with the centers of adjacent bores along each of said longitudinal grid lines being spaced apart by a distance $s_1$ and adjacent longitudinal grid lines being spaced apart by a distance $s_2$ and with the longitudinal grid lines next to said two side edges being spaced from said two side edges respectively, said bores being arranged along transverse grid lines normal to said longitudinal grid lines with alternate transverse grid lines being spaced apart by a distance $s_1$ and adjacent transverse grid lines being spaced apart by a distance $s_1/2$, the centers of adjacent bores along each transverse grid line being spaced apart by a distance $2s_2$, all of said bores having substantially the same size and being of dimensions such that parallel spaced apart straight strip regions extend diagonally between said two side edges and between said bores, each strip region forms equal acute angles with said two side edges and extends between a pair of adjacent bores along each of said longitudinal grid lines wherein the pairs of adjacent bores of adjacent longitudinal grid lines between which a given strip region extends are longitudinally spaced from each other with the centers of the closest bores of adjacent pairs of bores of adjacent longitudinal grid lines between which a given strip region extends being longitudinally spaced from each other by a distance of $s_1/2$, said method comprising the steps of:

cutting said metal strip along two of said spaced apart strip regions to form a sheet metal plate having two base edges defined by said two cut strip regions with one of said base edges defining the height of said sheet metal plate relative to the other of said base edges, wherein an increased number of bores are located along spaced apart lines parallel to said side edges for a given height of said sheet metal plate, and inserting pipes through said bores of said sheet metal plate to form said heat exchanger apparatus arranged such that the direction of flow of fluid through said heat exchanger apparatus exterior of said pipes will be generally parallel to said two base edges.

11. The method of claim 10, wherein:

each of said acute angles A is defined as follows:

$$A = \text{arc } tg \frac{2\,s_2}{3\,s_1}$$

the width c of each of said strip regions is defined as follows:

$$c = \frac{s_1}{\sqrt{1 + \left(\frac{3\,s_1}{2\,s_2}\right)^2}} - da$$

wherein:

$$da < \frac{s_1}{\sqrt{1 + \left(\frac{3\,s_1}{2\,s_2}\right)^2}}.$$

12. The method of claim 10 further comprising the step of forming a collar around each bore in said sheet metal plate by a flanging operation, said collars extending perpendicularly from said plate.

* * * * *